US007150616B2

(12) United States Patent
Haynes et al.

(10) Patent No.: US 7,150,616 B2
(45) Date of Patent: Dec. 19, 2006

(54) DIE FOR PRODUCING MELTBLOWN MULTICOMPONENT FIBERS AND MELTBLOWN NONWOVEN FABRICS

(75) Inventors: Bryan D. Haynes, Cumming, GA (US); Michael Charles Cook, Marietta, GA (US)

(73) Assignee: Kimberly-Clark Worldwide, Inc, Neenah, WI (US)

( * ) Notice: Subject to any disclaimer, the term of this patent is extended or adjusted under 35 U.S.C. 154(b) by 0 days.

(21) Appl. No.: 10/743,861

(22) Filed: Dec. 22, 2003

(65) Prior Publication Data

US 2005/0136144 A1 Jun. 23, 2005

(51) Int. Cl.
*D01D 5/088* (2006.01)

(52) U.S. Cl. ..... 425/7; 425/130; 425/131.1; 425/131.5; 425/462; 425/463

(58) Field of Classification Search ..... 425/7, 425/130, 131.1, 131.5, 462, 463
See application file for complete search history.

(56) References Cited

U.S. PATENT DOCUMENTS

| | | | | |
|---|---|---|---|---|
| 3,338,992 | A | 8/1967 | Kinney | |
| 3,341,394 | A | 9/1967 | Kinney | |
| 3,502,763 | A | 3/1970 | Hartmann | |
| 3,542,615 | A | 11/1970 | Dobo et al. | |
| 3,692,618 | A | 9/1972 | Dorschner et al. | |
| 3,802,817 | A * | 4/1974 | Matsuki et al. | 425/66 |
| 3,825,380 | A * | 7/1974 | Harding et al. | 425/72.2 |
| 3,849,241 | A | 11/1974 | Butin et al. | |
| 3,981,650 | A * | 9/1976 | Page | 425/72.2 |
| 4,340,563 | A | 7/1982 | Appel et al. | |
| 4,526,733 | A * | 7/1985 | Lau | 264/12 |
| 4,795,668 | A | 1/1989 | Krueger et al. | |
| 4,818,464 | A | 4/1989 | Lau | |
| 5,057,368 | A | 10/1991 | Largman et al. | |
| 5,069,970 | A | 12/1991 | Largman et al. | |
| 5,108,820 | A | 4/1992 | Kaneko et al. | |
| 5,108,827 | A | 4/1992 | Gessner | |
| 5,277,976 | A | 1/1994 | Hogle et al. | |
| 5,294,482 | A | 3/1994 | Gessner | |
| 5,336,552 | A | 8/1994 | Strack et al. | |
| 5,366,793 | A | 11/1994 | Fitts, Jr. et al. | |
| 5,382,400 | A | 1/1995 | Pike et al. | |
| 5,385,775 | A * | 1/1995 | Wright | 442/183 |
| 5,466,410 | A | 11/1995 | Hills | |
| 5,498,468 | A * | 3/1996 | Blaney | 428/198 |
| 5,540,992 | A | 7/1996 | Marcher et al. | |

(Continued)

FOREIGN PATENT DOCUMENTS

EP 0646663 A1 4/1995

(Continued)

OTHER PUBLICATIONS

Manson, J.A. et al., *Polymer Blends and Composites*, Plenum Press, N.Y., 1976, pp. 273-277.

(Continued)

*Primary Examiner*—Robert Davis
*Assistant Examiner*—G. Nagesh Rao
(74) *Attorney, Agent, or Firm*—Christos S. Kyriakou; Robert A. Ambrose

(57) ABSTRACT

A die tip adapted for extruding a plurality of meltblown multicomponent filaments that includes at least two series of conduits that extend and converge in to the interior of the die tip to convey a multicomponent thermoplastic structure in to the interior of the die tip to a series of capillaries that extend to a series of die opening for extruding multicomponent filaments is provided.

18 Claims, 4 Drawing Sheets

U.S. PATENT DOCUMENTS 5,580,581 A * 12/1996 Buehning ..... 425/7
5,601,851 A * 2/1997 Terakawa ..... 425/72.2
5,632,938 A * 5/1997 Buehning, Sr. ..... 264/39
5,695,377 A * 12/1997 Triebes et al. ..... 442/359
5,711,970 A * 1/1998 Lau et al. ..... 425/72.2
5,935,883 A 8/1999 Pike
5,975,871 A * 11/1999 Kudert et al. ..... 425/130
5,989,004 A 11/1999 Cook
6,001,303 A 12/1999 Haynes et al.
6,200,120 B1 * 3/2001 Fish et al. ..... 425/83.1
6,336,801 B1 * 1/2002 Fish et al. ..... 425/7
6,350,401 B1 * 2/2002 Gellert et al. ..... 264/255
6,461,133 B1 10/2002 Lake et al.
6,461,138 B1 * 10/2002 Kegasawa et al. ..... 425/133.5
6,474,967 B1 11/2002 Haynes et al.
6,565,344 B1 * 5/2003 Bentley et al. ..... 425/72.2
6,579,084 B1 * 6/2003 Cook ..... 425/463
6,605,248 B1 * 8/2003 Rudisill et al. ..... 264/555
6,627,025 B1 * 9/2003 Yu ..... 156/167
6,746,226 B1 * 6/2004 Moore ..... 425/131.5
6,776,858 B1 * 8/2004 Bansal et al. ..... 156/62.4
6,814,555 B1 * 11/2004 Allen ..... 425/72.2
6,833,104 B1 * 12/2004 Berger ..... 264/555
2002/0034909 A1 * 3/2002 Bansal et al. ..... 442/361
2004/0157522 A1 * 8/2004 Bansal et al. ..... 442/327

FOREIGN PATENT DOCUMENTS

EP 1239065 A1 9/2002
WO WO 99/32692 7/1999

OTHER PUBLICATIONS

Patent Abstracts of Japan, JP 63075106, Apr. 5, 1988, Toray Ind Inc.
Patent Abstracts of Japan, JP 02289107, Nov. 29, 1990, Kuraray Co Ltd.

* cited by examiner

DIE FOR PRODUCING MELTBLOWN MULTICOMPONENT FIBERS AND MELTBLOWN NONWOVEN FABRICS

FIELD OF THE INVENTION

The present invention relates to an apparatus for producing meltblown multicomponent fibers.

BACKGROUND

Challenges are encountered when plastic meltblown fibers are melt extruded from a synthetic resin to form a meltblown nonwoven fabric. Ordinarily a large number of threads are extruded from a single extrusion head, and among the challenges that are encountered are obtaining uniform thread size, uniform temperature across the whole of the extrusion head, and uniform flow distribution and pressure on extrusion orifices or spinnerettes. It would be desirable to provide an apparatus and a method of extruding a large number of fibers that provides uniform flow and temperature to the polymer composition from which the fibers are extruded and that imparts the same processing conditions and processing history to the melted polymer compositions at similar positions in the melt extrusion process. The spinnerettes may be single orifice spinnerettes for monofilament threads or groups of orifices to produce a multi-filament thread. Spinnerettes are well known and are described and illustrated in U.S. Pat. No. 4,445,833 the disclosure of which is hereby incorporated by reference herein.

An early attempt to extrude improved melt extruded fibers and nonwoven materials was suggested in U.S. Pat. No. 3,825,380 to Harding et al. However, U.S. Pat. No. 3,825,380 does not disclose or teach an apparatus for extruding multicomponent fibers and nonwoven materials, particularly sheath/core meltblown fibers and other complex meltblown fiber structures. Other attempts to solve the problems are presented in U.S. Pat. No. 4,828,464 to Lau et al., U.S. Pat. No. 6,461,133 to Lake et al. and U.S. Pat. No. 6,474,967 to Haynes et al.

Sheath/core like meltblown fibers can be produced by using an ABA structure and matching the viscosities of the sheath forming polymer resin and the core forming polymer resin to cat-eye fibers as described in U.S. Pat. No. 6,747,967 to Haynes et al. It would be desirable to provide a die tip, an apparatus, and/or a process that can be used to produce true bicomponent meltblown sheath/core fibers and other complex meltblown fiber structures that is less dependent on viscosity matching of the components.

SUMMARY

The present invention provides a die adapted for extruding a plurality of meltblown multicomponent filaments that includes: a first surface that includes a first plurality of orifices of a first diameter for receiving a multicomponent structure wherein each of the first plurality of orifices extend from the first surface to a first conduit that extends in the interior of the die to convey the multicomponent thermoplastic structure in to the interior of the die to a capillary having a diameter smaller than the first diameter and then to a die opening wherein the first plurality of conduits define a first plane; the first surface further includes a second plurality of orifices of the first diameter for receiving a multicomponent structure wherein each of the second plurality of orifices extend from the first surface to a second conduit that extends in the interior of the die to convey the multicomponent thermoplastic structure in to the interior of the die to a capillary having a diameter smaller than the first diameter and then to a die opening wherein the first plurality of conduits define a second plane; wherein the first plane and the second plane are not coplanar and intersect at an angle $\alpha$ and the first plurality of conduits and the die openings are adapted to extrude meltblown fibers. The first plurality of orifices and first conduits alternate with the second plurality of orifices and second conduits. The die may include additional pluralities of orifices and conduits alternating with the first and second pluralities of orifices and conduits. The die of Claim the average diameter of the die openings may range from about 0.07 millimeters to about 0.7 millimeters. The average diameter of the die openings may range about 0.3 millimeters to about 0.4 millimeters. The angle $\alpha$ may range from about 10° to about 50°, from about 20° to about 40° and from about 30° to about 40°.

In one particular embodiment, each of the first conduits that extends in the interior of the die connects to a first conduit of reduced diameter that connects to a capillary, wherein the reduced diameter of the conduits of reduced diameter is less than the first diameter of the first conduits and greater than or equal to the diameter of the capillary and the second conduits that extends in the interior of the die connects to a second conduit of reduced diameter that connects to a capillary, wherein the reduced diameter of the conduits of reduced diameter is less than the first diameter of the first conduits and greater than or equal to the diameter of the capillary. Desirably, the first conduits of reduced diameter are coplanar with the first conduits and the second conduits of reduced diameter are coplanar with the second conduits. More desirably, each of the first plurality of orifices converges to and is in fluid communication with a capillary and each of the second plurality of orifices converges to and is in fluid communication with a capillary wherein the capillaries define a third plane that is intermediate the first plane and the second plane. Desirably, the die openings are linearly arranged and there are at least 20 die openings per inch of die.

The present invention also provides a die tip adapted for extruding a plurality of meltblown multicomponent filaments that includes: a first series of first conduits of a first diameter that extend in the interior of the die tip to convey a multicomponent thermoplastic structure in to the interior of the die tip, a second series of second conduits of the first diameter that extend in the interior of the die tip to convey the multicomponent thermoplastic structure in to the interior of the die tip, wherein the first series of conduits and the second series of conduits converge toward and connect to a series of capillaries for conveying the multicomponent structure to die openings for extruding fibers wherein the capillaries each have a diameter smaller than the first diameter, and each conduit connects to a capillary and each capillary connects to a die opening wherein capillary that connects to a first conduit is not adjacent another conduit that connects to a first capillary. A capillary that connects to a first conduit is adjacent to a capillary that connects to a second conduit. In certain embodiments, a capillary that connects to a first conduit is between adjacent capillaries that connects to second conduits. In other embodiments, a capillary that connects to a first conduit is between an adjacent capillary that connects to a second conduit and an adjacent capillary that connects to conduit that is not coplanar with the first series of series of conduits or the second series of conduits. The average diameter of the die openings may range from about 0.07 millimeters to about 0.7 millimeters. More desirably, the average diameter of the die openings may range about 0.3 millimeters to about 0.4 millimeters. The die may include at least 20 die openings per inch, and more desirably, at least 30 die openings per inch.

The invention will be described in greater detail below with reference to the appended figures.

DEFINITIONS

As used herein and in the claims, the term "comprising" is inclusive or open-ended and does not exclude additional unrecited elements, compositional components, or method steps.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns. The fibers may also have shapes such as those described in U.S. Pat. No. 5,277,976 to Hogle et al., U.S. Pat. No. 5,466,410 to Hills and U.S. Pat. Nos. 5,069,970 and 5,057,368 to Largman et al., which describe fibers with unconventional shapes.

As used herein the term "meltblown fibers" means fibers formed by extruding a molten thermoplastic material through a plurality of fine, usually circular, die capillaries as molten threads or filaments into converging high velocity gas streams, usually hot air, which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

As used herein, "filament arrays" means substantially parallel rows of filaments which may be such as those disclosed in U.S. Pat. Nos. 5,385,775 and 5,366,793.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement, a pie arrangement or an "islands-in-the-sea" arrangement. Conjugate fibers are taught in U.S. Pat. No. 5,108,820 to Kaneko et al., U.S. Pat. No. 4,795,668 to Krueger et al., U.S. Pat. No. 5,540,992 to Marcher et al. and U.S. Pat. No. 5,336,552 to Strack et al. Conjugate fibers are also taught in U.S. Pat. No. 5,382,400 to Pike et al. and may be used to produce crimp in the fibers by using the differential rates of expansion and contraction of the two (or more) polymers. For two component fibers, the polymers may be present in ratios of 75/25, 50/50, 25/75 or any other desired ratios. The fibers may also have shapes such as those described in U.S. Pat. No. 5,277,976 to Hogle et al., U.S. Pat. No. 5,466,410 to Hills and U.S. Pat. Nos. 5,069,970 and 5,057,368 to Largman et al., which describe fibers with unconventional shapes.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. Nos. 5,108,827 and 5,294,482 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

DETAILED DESCRIPTION OF REPRESENTATIVE EMBODIMENTS

Reference will now be made in detail to embodiments of the invention, one or more examples of which are set forth in the figures and described below. Each example is provided by way of explanation of the invention, and not meant as a limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield still a further embodiment. Thus, it is intended that the present invention include such modifications and variations.

The present invention relates to an improved die tip for use in any commercial or conventional meltblown apparatus for producing multicomponent fibers. In the illustrated embodiment the multicomponent fibers are bicomponent fibers of a sheath/core configuration. Meltblown apparatuses are well known to those skilled in the art and a detailed description thereof is not necessary for purposes of an understanding of the present invention. A meltblown apparatus will be described generally herein to the extent necessary to gain an appreciation of the invention. Processes and devices for forming bicomponent or "conjugate" polymer fibers are also well known by those skilled in the art. Polymers and combinations of polymers particularly suited for conjugate bicomponent fibers are disclosed, for example, in U.S. Pat. No. 5,935,883, the entire disclosure of which is incorporated herein by reference for all purposes.

Figure 1:
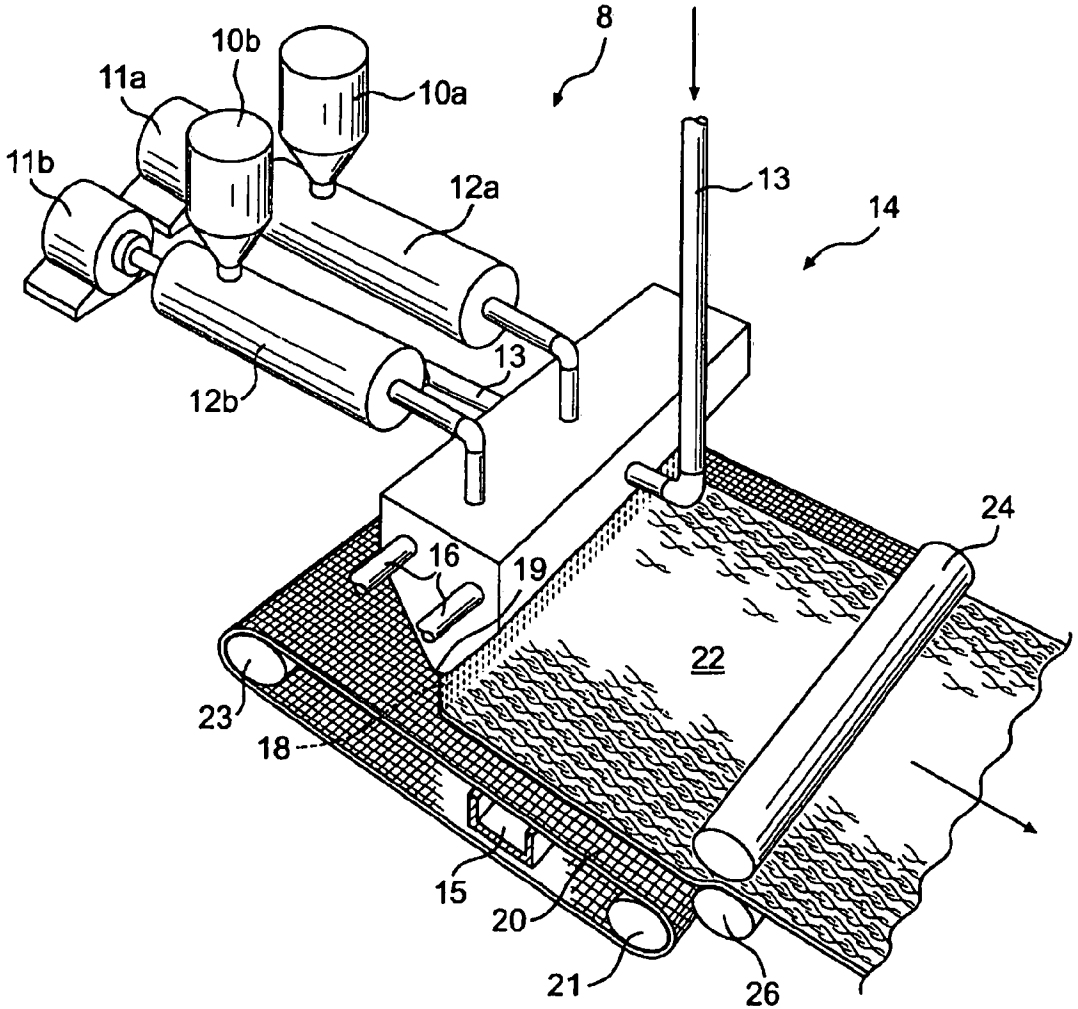
FIG. 1 is a simplified perspective view of a meltblown apparatus for producing bicomponent fibers.

Turning to FIG. 1, a simplified view is offered of a meltblown apparatus 8 for producing bicomponent polymer fibers 18. Hoppers 10*a* and 10*b* provide separate polymers to respective extruders 12*a* and 12*b*. The extruders, driven by motors 11*a* and 11*b*, are heated to bring the polymers to a desired temperature and viscosity. The molten polymers are separately conveyed to a die head assembly, generally 14, which is also heated by means of heater 16 and connected by conduits 13 to a source of attenuating fluid. At the exit 19 of die 14 bicomponent fibers 18 are formed and collected with the aid of a suction box 15 under a forming belt 20. The fibers are drawn and may be broken by the attenuating gas and deposited onto the moving belt 20 to form web 22. The web may be compacted or otherwise bonded by rolls 24, 26. Belt 20 may be driven or rotated by rolls 21, 23. The present invention is also not limited to any particular type of attenuating gas system. The invention may be used with a hot air attenuating gas system, or a cool air system, for example as described in U.S. Pat. No. 4,526,733; International Publication No. WO 99/32692; and U.S. Pat. No. 6,001,303, the entire disclosures of which are incorporated herein in their entirety for all purposes.

Figure 2:
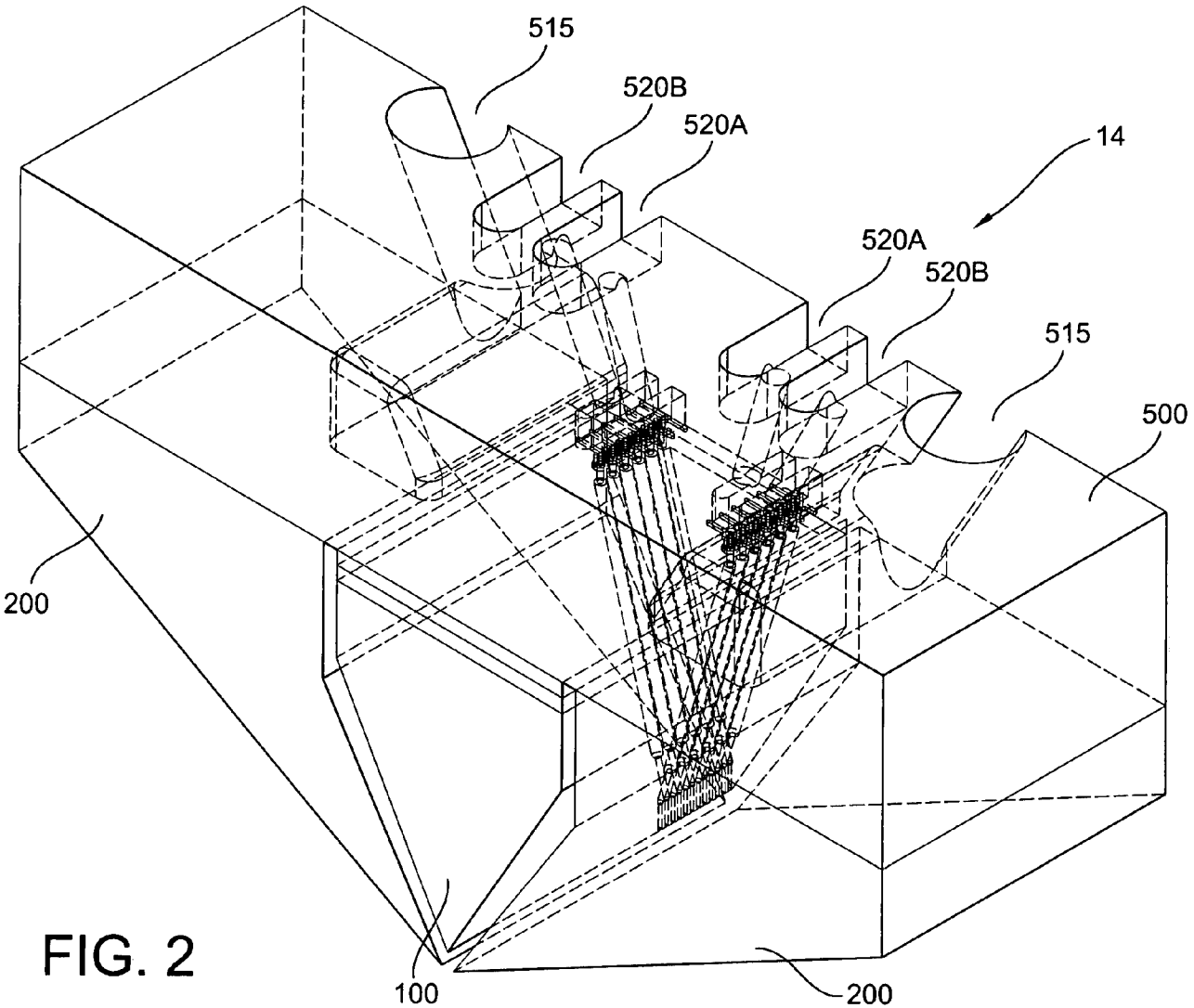
FIG. 2 is a perspective view of a die of the present invention as a component of an exemplary assembly for or producing meltblown, bicomponent fibers.
Figure 3:
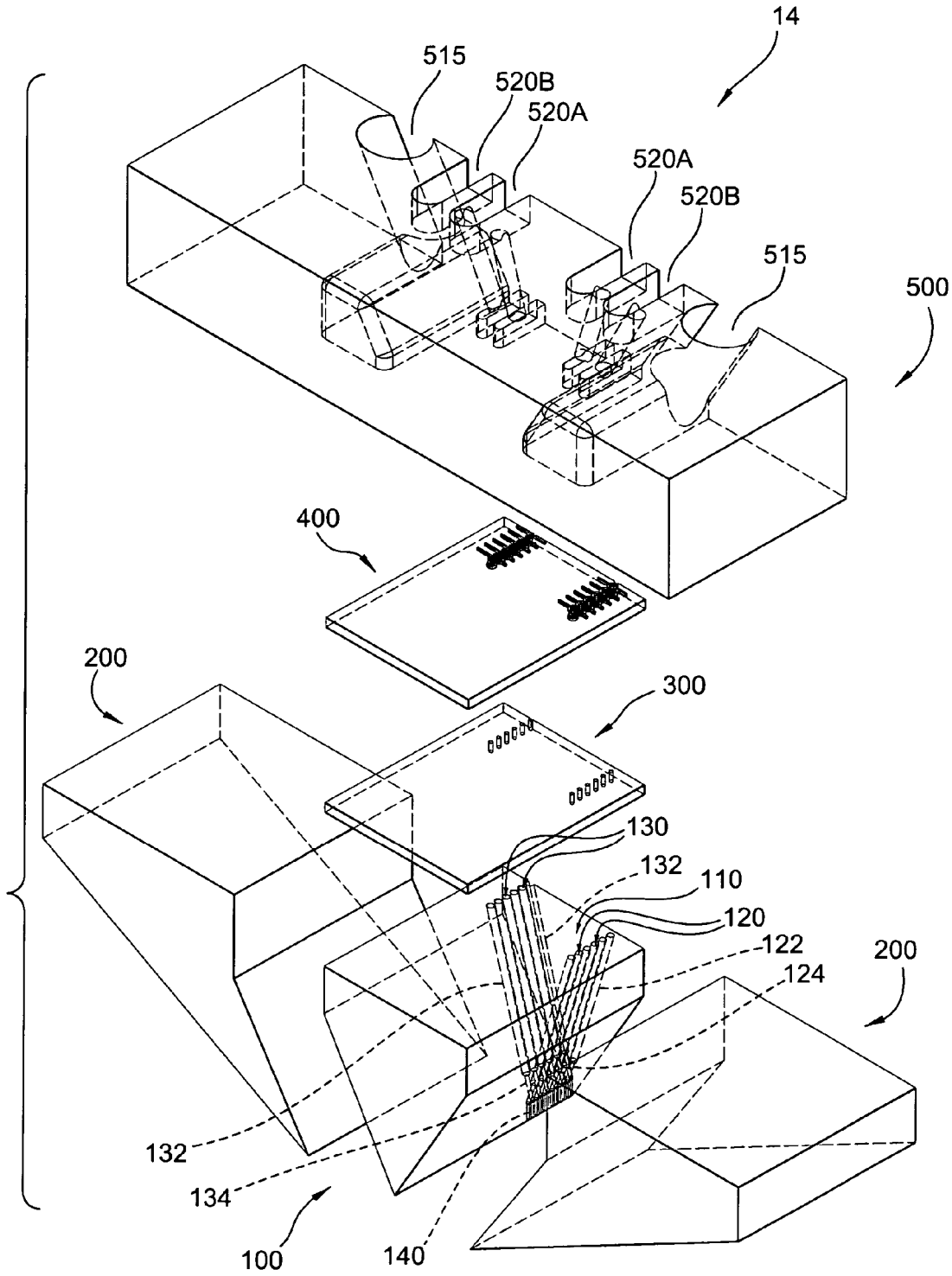
FIG. 3 is an exploded perspective view of the die and assembly of FIG. 1.
Figure 4:
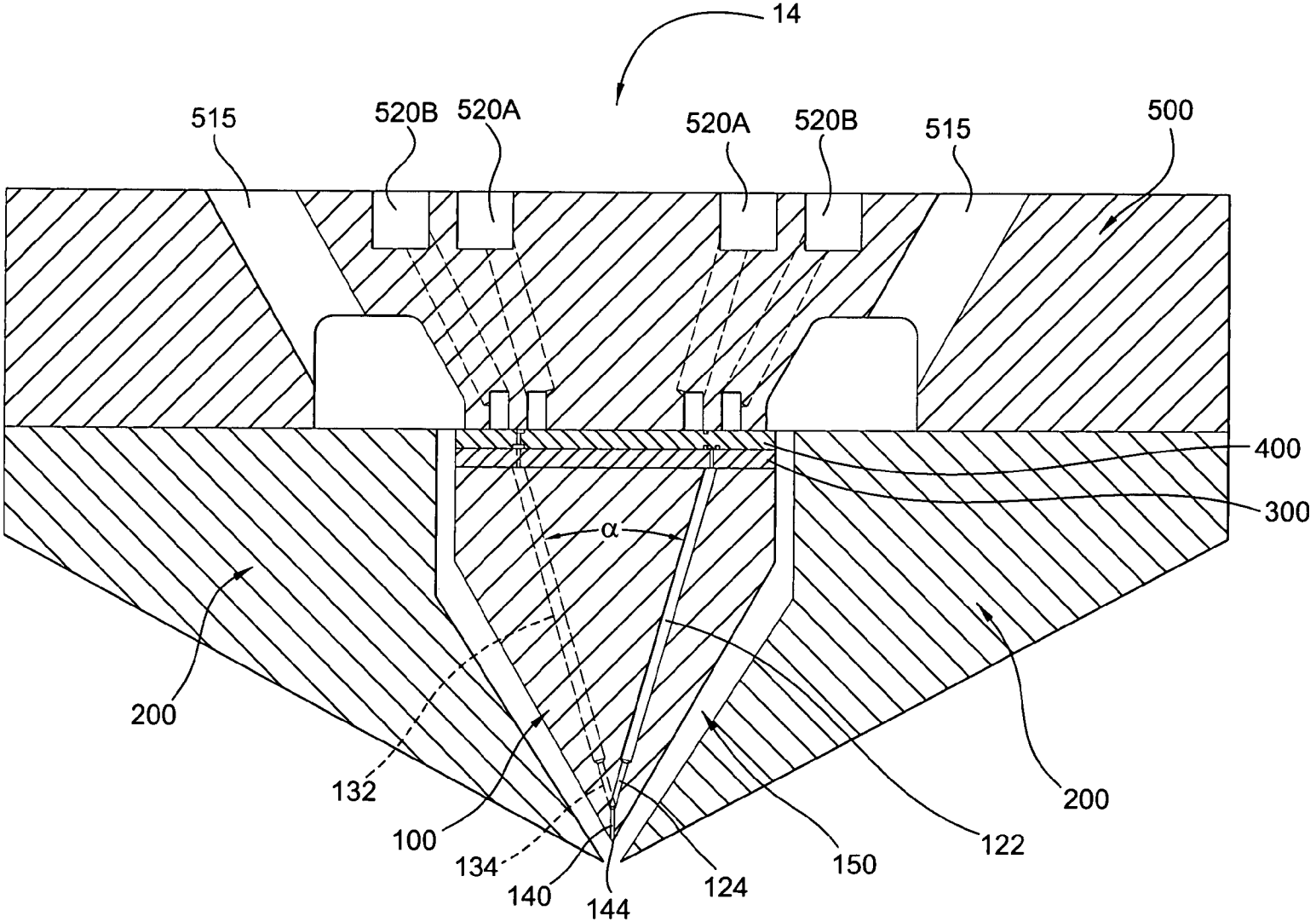
FIG. 4 is a cross-sectional view of the die and assembly of FIG. 1.

An embodiment of a die head assembly 14 according to the present invention is illustrated in a perspective view in FIG. 2, in an exploded perspective view in FIG. 3 and in a cross-sectional view in FIG. 4. Dashed lines represent internal structure(s) that cannot be seen from the exterior of the article in the view illustrated. Assembly 14 includes a die tip 100 that is detachably mounted to an underside of a support member (not shown). The support member may comprise a bottom portion of the die body, or a separate plate or member that is mounted to the die body. The die head assembly 14 including the die tip 100 may be mounted to a support member by way of bolts (not shown). Separate first and second polymer supply channels or passages 520A and 520B are defined through distribution plate 500. These supply passages may be considered as polymer feed tubes. A first molten polymer composition A is conveyed to channels 520A of distribution plate 500 and a second molten polymer composition B is conveyed to channels 520B of distribution plate 500 to a first structure developing plate 400 then to a second structure developing plate 300 and then to die tip 100. A variety of configurations of passages or channels may be utilized to separately convey the molten polymers through distribution plate 500 and structure developing plates 300 and 400 to die tip 100. Hot air may be forced through a plurality of air channels 515 to air slots 150 to attenuate fibers that are extruded through a plurality of linearly arranged die openings 144.

In the exemplary and illustrated embodiment, die tip 100 is adapted for extruding a plurality of meltblown multicomponent filaments that include two distinct and different thermoplastic compositions A and B in a sheath/core bicomponent structure. The sheath/core bicomponent structures are developed before the die tip 100 in distribution plate 500 and structure developing plates 300 and 400. Sheath/core bicomponent structures are well known and methods and distribution and structure developing plates for producing bicomponent structures are also known. Examples of distribution plates are known. Distribution plates are also referred to as breaker plates and are described in U.S. Pat. No. 6,474,967 to Haynes et al. and U.S. Pat. No. 5,989,004, both of which are also hereby incorporated herein in their entireties. Other exemplary distribution plates are described in copending U.S. patent application Ser. No. 10/335,498 and copending U.S. patent application Ser. No. 10/745,131 titled "Apparatus and Method For Multicomponent Fibers" filed by Express Mail Procedure EL 955701930 US contemporaneously herewith, both of which are also hereby incorporated herein in their entireties. Desirably, the two or more polymer components of the multicomponent structure are not pooled and are not combined until the multicomponent structures are developed.

Turning to FIG. 3, die tip 100 includes a first, upper surface 110 that includes a first plurality of orifices 120 of a first diameter for receiving a multicomponent structure from distribution plate 300 above. Die tip 100 also includes a second plurality of orifices 130 of a first diameter on the a first, upper surface 110 for receiving a multicomponent structure from distribution plate 300 above. Typically, the multicomponent structures entering the orifices 120 and 130 are the same but can vary if desired. The first plurality of orifices 120 are arranged in a first line and the second plurality of orifices 130 are arranged in a second parallel line. Each of the first plurality and second plurality of orifices extend from the first surface to a first series of conduits 122 and a second conduit series of conduits 132 that enter the die at different angles. Each of the conduits 122 of the first series of conduits are coplanar with each other and each of the conduits 132 of the second series of conduits are coplanar with each other. Additional series of conduits may be included that enter at different angles. Desirably, the length of the each conduit is substantially the same and the travel time of molten polymer through any conduit should be substantially the same as the travel time through any other conduit. The first series of conduits 122 and a second conduit series of conduits 132 converge and extend in the interior of the die tip forming an angle $\alpha$, as shown on FIG. 4, to convey multicomponent thermoplastic structures in to the interior of the die tip to a series of fine capillaries 140. The fine capillaries 140 lead to die openings 144 that have diameters small enough to produce meltblown fibers and may range from about 0.7 millimeter to about 7 millimeters, more desirably from about 0.3 millimeters to about 0.4 millimeters. The die openings 144 should be arranged linearly so that air or another gas may be directed at the molten filaments that are extruded from capillaries 140 to attenuate the molten filaments. The fine capillaries 140 may also be arranged linearly and all in one plane to facilitate drilling of the fine capillaries and manufacturing of the die.

The diameters of the first conduits 122 and the second conduits 134 should be larger than the diameters of the capillaries. The first conduits 122 and the second conduits 134 may each extend to first conduits of reduced diameter 124 and the second conduits of reduced diameter 134 to further reduce the cross-sectional area of the multicomponent structures before the capillaries 140 and the die openings 144. Desirably, the die tip is a solid, one-piece structure.

Desirably, the die tip 100 is formed from a solid block of material, for example a solid block of steel or another iron alloy, and the conduits and capillaries may be drilled into a solid block of material to form the die tip. For example, the entrance conduits may be drilled from the top surface or another entry surface at angle using a bit or of a first diameter and the exit capillaries may be drilled from the bottom surface or another exit surface using a bit of a smaller diameter so that the cross-section of the capillary is reduced as the polymer travels through the die. The diameters of the conduits can be optionally reduced in stages by drilling the conduits in progressively smaller diameters as the conduits extend further into the die and eventually to the capillaries and then to the die openings. Each conduit extends to and connects with an individual capillary and each capillary extends to and connects to a die opening. Advantageously, die of the present invention can bring a multicomponent structure close that is developed close to the die openings to the die opening so that the multicomponent structure is maintained.

It is desirable to have many capillaries or die openings per inch to improve the uniformity of nonwoven materials produced using the die and to more efficiently use the blowing gas. It is suggested that dies of the present invention include from about 10 to about 40 capillaries per inch, and even 100 capillaries per inch may be possible. The present invention provides a die design that is capable of providing a die tip within the desired capillary diameter and capillary densities by angling the conduits that lead to adjacent capillaries and alternating the sides from which adjacent conduits angle. For example, the two conduits that lead to the two capillaries that are adjacent any one capillary and the conduit that leads to the intermediate capillary are not all in the same plane and thus do not interfere or commingle with each other. Desirably, the capillaries and the die openings at the ends of the capillaries are in a line and are spaced in a uniform manner and may extend over the entire length or much of the length of the die which may have a length of 40 inches or more. The capillaries are illustrated as being circular in cross-section but may be oval or another shape so that the capillaries produce trilobal, bilobal, triangular or even hollow fibers.

Advantageously, the present invention provides a die that is adapted to produce fine, multicomponent meltblown fibers with complex structures, for example bicomponent meltblown sheath/core fibers. Other examples of complex fiber structures include, but are not limited to, stripe or ribbon fibers, segmented pie fibers, islands-in-the-sea fibers, and so forth. Multicomponent structures also include, but are not limited to, bicomponent structures, tricomponent structures, quadcomponent structures and so forth. Advantageously, dies of the present invention preserve and convey complex multicomponent structures to a series of exit orifices to produce meltblown fibers having complex multicomponent structures such as true sheath/core bicomponent fiber structures. True sheath/core meltblown fibers are difficult to produce as opposed to fibers having cat eye structures that are developed from side-by-side ABA fiber structures and approximate sheath/core fibers. Fine meltblown fibers are formed and drawn at the exit orifices. The complex fiber structures are developed in distribution plates upstream of the die tip to a series of exit orifices.

Many thermoplastic compositions may be formed into nonwoven fabrics by meltblowing processes. Generally, the basic meltblowing process consists of applying a hot gas stream, usually a hot air stream, to two diametrically opposed sides of emerging molten polymer streams to elongate the melt streams and produce fine fibers. The molten, elongated fiber streams can be collected on a screen as a web of a fibrous nonwoven material. Meltblowing process are described in greater detail in U.S. Pat. No. 3,849,241 to Butin et al. A conventional apparatus for producing meltblown fibers and fibrous nonwoven material is described in U.S. Pat. No. 3,825,380 to Hardin et al.

The conventional apparatus is adapted to produce monocomponent fibers or fibers from polymer blends in which the component polymers of the blend are not arranged in substantially constantly positioned distinct zones across the cross-section of the fibers and do extend continuously along the length of the fibers. In contrast, the present invention is directed to a die that is adapted to produce multicomponent meltblown fibers and nonwoven materials including such multicomponent meltblown fibers in which two or more components are arranged in substantially constantly positioned distinct zones across the cross-section of the fibers and extend continuously along the length of the fibers. Dies designed in accordance with the present invention permit multicomponent fibers through a die having a high capillary density and small capillary diameters. For example, dies of the present invention may include at least 10 capillaries per inch, more desirably 20 capillaries per inch and still more desirably 40 capillaries per inch. Meltblown fibers exiting the capillaries may have diameters that are less than about 10 microns. More desirably, the meltblown fibers may have diameters that are less than about 5 microns and even less than about 2 microns. Thus, the diameters of the orifices at the point the fibers exit the capillaries may be 10 microns or less, desirably 5 microns or less and even more desirably 1 microns or less. As used herein, "diameter" is not limited to the general definition of diameter as it relates to circular cross-sections but also includes diameters of non-circular cross-sections such as ellipses and generally defines the longest dimension of such cross-sections.

While the present invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A die adapted for extruding a plurality of meltblown multicomponent filaments, the meltblown multicomponent filaments comprising at least two different thermoplastic resins arranged in a multicomponent structure, wherein the die comprises:

a first surface that comprises a first plurality of orifices of a first diameter wherein each of the first plurality of orifices extend from the first surface to a first conduit that extends in the interior of the die to a capillary having a diameter smaller than the first diameter and then to a die opening wherein the first plurality of conduits define a first plane;

the first surface further comprises a second plurality of orifices of the first diameter wherein each of the second plurality of orifices extend from the first surface to a second conduit that extends in the interior of the die to a capillary having a diameter smaller than the first diameter and then to a die opening wherein the second plurality of conduits define a second plane, wherein the first plurality of orifices and first conduits alternate with the second plurality of orifices and second conduits;

wherein the first plane and the second plane are not coplanar and intersect at an angle α.

2. The die of claim 1 wherein the average diameter of the die openings ranges from about 0.07 millimeters to about 0.7 millimeters.

3. The die of claim 1 wherein the average diameter of the die openings ranges about 0.3 millimeters to about 0.4 millimeters.

4. The die of claim 1 wherein the angle a ranges from about 10° to about 50°.

5. The die of claim 1 wherein the angle a ranges from about 20° to about 40°.

6. The die of claim 1 wherein the angle a ranges from about 30° to about 40°.

7. The die of claim 1 wherein each of the first conduits that extends in the interior of the die connects to a first conduit of reduced diameter that connects to a capillary, wherein the reduced diameter of the conduits of reduced diameter is less than the first diameter of the first conduits and greater than or equal to the diameter of the capillary and the second conduits that extends in the interior of the die connects to a second conduit of reduced diameter that connects to a capillary, wherein the reduced diameter of the conduits of reduced diameter is less than the first diameter of the first conduits and greater than or equal to the diameter of the capillary.

8. The die of claim 4 wherein the first conduits of reduced diameter are coplanar with the first conduits and the second conduits of reduced diameter are coplanar with the second conduits.

9. The die of claim 1 wherein each of the first plurality of orifices converges to and is in fluid communication with a capillary and each of the second plurality of orifices converges to and is in fluid communication with a capillary wherein the capillaries define a third plane that is intermediate the first plane and the second plane.

10. The die of claim 1 wherein the die openings are linearly arranged.

11. The die of claim 1 comprising at least 20 die openings per inch.

12. A die tip adapted for extruding a plurality of meltblown multicomponent filaments, the meltblown multicomponent filaments comprising at least two different thermoplastic resins arranged in a multicomponent structure, wherein the die tip comprises:

a first series of first conduits of a first diameter that extend in the interior of the die tip, a second series of second conduits of the first diameter that extend in the interior of the die, wherein the first series of conduits and the second series of conduits converge toward and connect to a series of capillaries to die openings wherein the capillaries each have a diameter smaller than the first diameter, and each conduit connects to a capillary and each capillary connects to a die opening wherein a capillary that connects to a first conduit is adjacent to a capillary that connects to a second conduit.

13. The die tip of claim 12 wherein a capillary that connects to a first conduit is between adjacent capillaries that connects to second conduits.

14. The die tip of claim 12 wherein a capillary that connects to a first conduit is between an adjacent capillary that connects to a second conduit and an adjacent capillary that connects to conduit that is not coplanar with the first series of series of conduits or the second series of conduits.

15. The die tip of claim 12 wherein the average diameter of the die openings ranges from about 0.07 millimeters to about 0.7 millimeters.

16. The die tip of claim 12 wherein the average diameter of the die openings ranges about 0.3 millimeters to about 0.4 millimeters.

17. The die of claim 1 comprising at least 20 die openings per inch.

18. The die of claim 1 comprising at least 30 die openings per inch.

* * * * *